United States Patent [19]

Focke et al.

[11] Patent Number: 4,466,577

[45] Date of Patent: Aug. 21, 1984

[54] PROCESS AND APPARATUS FOR FEEDING SUCCESSIVE WEBS OF PACKAGING MATERIAL

[75] Inventors: Heinz Focke; Kurt Liedtke, both of Verden, Fed. Rep. of Germany

[73] Assignee: Focke & Co., Verden, Fed. Rep. of Germany

[21] Appl. No.: 277,501

[22] Filed: Jun. 26, 1981

[30] Foreign Application Priority Data

Jul. 17, 1980 [DE] Fed. Rep. of Germany ..... 3026995

[51] Int. Cl.[3] ..... B65H 19/00; B65H 19/06; B65H 19/10

[52] U.S. Cl. ..... 242/58; 242/58.1; 242/58.4; 242/64

[58] Field of Search ..... 242/56 A, 58.3, 58.6, 242/58.1, 58.2, 58.4, 59, 64, 58; 156/504, 505, 506; 53/389, 64; 83/649, 650

[56] References Cited

U.S. PATENT DOCUMENTS

| | | | |
|---|---|---|---|
| 1,402,989 | 1/1922 | Wood | 242/58.1 |
| 1,767,728 | 6/1930 | Ball | 242/58.3 |
| 2,017,343 | 10/1935 | Durham | 242/58.3 |
| 3,103,320 | 9/1963 | Huck | 242/58.3 |
| 3,172,613 | 3/1965 | Simons | 242/58.2 |

*Primary Examiner*—Stuart S. Levy
*Assistant Examiner*—Lloyd D. Doigan
*Attorney, Agent, or Firm*—Sughrue, Mion, Zinn, Macpeak and Seas

[57] ABSTRACT

A process and an apparatus for continuously supplying sheets from a plurality of supply rolls to a packaging machine utilizes a transfer device for transferring an end of a fuel reel into a path of movement of an end of an emptying reel so that these ends are displaced from one another by a small distance which is between 5 and 15 mm. The transfer device includes first and second suction conveyors which have a small section which overlaps so that the end of the full reel can be transferred into the path of movement of the end of the emptying reel.

29 Claims, 7 Drawing Figures

PROCESS AND APPARATUS FOR FEEDING SUCCESSIVE WEBS OF PACKAGING MATERIAL

BACKGROUND OF THE INVENTION

The invention relates to a process for connecting the ends of sheets or webs running off from reels (supply rolls) or the like, especially for packaging material in packaging machines, a first running sheet being severed from an emptied reel and the start of a second running sheet being fed from a full reel and being connected to the first running sheet.

High-performance packaging machines have, because of the packs made per unit of time, a correspondingly high packaging material requirement. In this process, the blanks for the packs are made, in or on the packaging machine, by severing continuous sheets of packaging material (paper, tinfoil, transparent film, plastic film or the like). Because of the finite length of the sheets of packaging material, which are present in the form of reels (supply rolls), it is necessary from time to time to replace the emptied reels by full ones. During this loading of the packaging machine, the latter has to be stopped, so that the start of the sheet of the full reel can be connected to the end of the sheet on the emptied reel.

Attempts to mechanize or carry out automatically the connection of the start of a new sheet to the end of a sheet on an emptied roll have not provided any results satisfactory in practice. The main difficulty is the fact that, after the full new reel has been connected and its sheet has been introduced into the packaging process, the next full reel located in storage has to be brought by hand into a position of readiness so that it can be introduced into the packaging process next.

SUMMARY OF THE INVENTION

The object on which the invention is based is to propose measures which permit a completely independent supply of material in sheet form, especially packaging material, to the packaging machine or similar equipment by drawing sheets successively off from a plurality of supply reels.

To achieve this object, the process according to the invention is characterised in that the start of the new sheet to be connected is taken off from a rotating full reel by means of a transfer device (fixed suction conveyor) and is introduced into a plane of movement (conveying plane) of the sheet on the emptied reel.

By means of the above measure, the supply reels can be changed in a trouble-free and fault-free manner even in the case of high-performance machines. In this case, the start of the new sheet to be connected is preferably introduced into the plane of movement of the severed sheet on the emptied reel, without overlapping with the end of the severed sheet. The end of the new sheet is kept a short distance from the end of the severed sheet. This means that a small gap is formed between the successive ends of the sheets. This leads to one, or at most two, faulty packs which are separated out of the production process in a conventional way. In contrast to this, disturbances of the entire installation, which arise when the sheet ends overlap one another and, if appropriate, are connected to one another by gluing, are prevented.

The start of the new sheet to be connected is introduced into the plane of movement of the severed sheet in the region of a vertical section of the latter or in a preceding inclined section in which the sheets are directed by special guide members.

The apparatus according to the invention covers the entire range of the constant and continuous supply to the packaging machine or the like of packaging material which is drawn off as a sheet from reels. Especially important is the change of the running sheet from an emptied reel to a full reel. According to the invention, the emptied reel, together with the running-off sheet being fed therefrom, and the full reel are each held in a position of readiness by means of a reel support, and located adjacent to the periphery of the full reel is a transfer device, by which the free end of the new sheet to be connected can be gripped, when the full reel is driven to rotate, and can be introduced into the plane of movement of the running-off sheet. In a preferred exemplary embodiment of the invention, the transfer device consists of at least one, but preferably two successive suction conveyors in the form of suction conveyor belts which lie with their conveying sides in the plane of movement of the running severed sheet and the new sheet to be connected.

The reel support is designed as a double-armed supporting framework, at the ends of which reels are mounted on reel holders. The reel support can be pivoted about a horizontal axis, so that, in a substantially horizontal position, the full reel is kept in a waiting or connecting position and the running-off reel is kept in a run-off position. When the reel support is in an upright position, a run-off reel or a remaining reel core is moved into a discarding position. The reel holder which is then free enters a loading position, with the reel support again aligned horizontally. During the abovementioned movements and in the various positions, the running sheet is drawn off uninterruptedly from an "active" reel. Only during the phase of severing the running sheet from an emptied reel and of connecting the start of a full reel is the working speed of the following unit (packaging machine) throttled, namely shifted down to a so-called crawling speed.

According to a further important proposal of the invention, a sufficient supply of full reels is constantly kept ready in the loading station. These are automatically fed in succession to the reel support, namely the reel holder located in the loading position at that time.

For this purpose, the reels kept in store are received, in an upright position, that is to say with horizontally aligned axes, in a supporting device in the form of a supporting trough. This is equipped with an advancing member, by means of which the reel which is then facing the reel support is pushed onto the reel holder in the loading position of the latter.

Further features of the invention relate to the design and the functions of the reel support, the transfer device for the sheets and the loading device for the full reels.

BRIEF DESCRIPTION OF THE DRAWINGS

An exemplary embodiment of the apparatus is described in more detail below with reference to the drawings in which.

DETAILED DESCRIPTION OF THE PREFERRED EMBODIMENT

Figure 1:
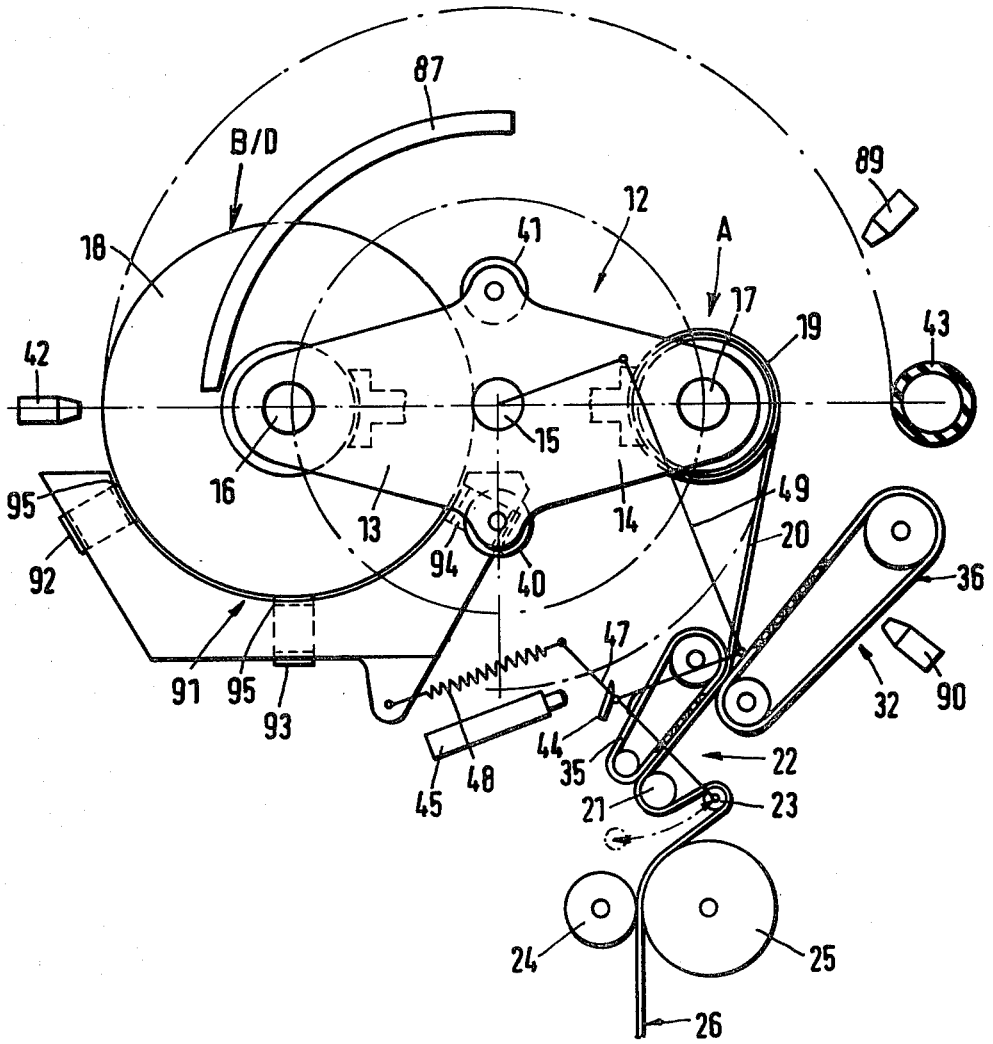
FIG. 1 shows the essential parts of the apparatus in a diagrammatic side view, with a running-off sheet.

The automatically working apparatus, illustrated in the drawings, for the continuous supply of packaging material to, for example, packaging machines, is represented as an isolated unit which can be connected to the packaging machine which further processes the packaging material. For this purpose, the unit shown is mounted on or against a central supporting column 10 (FIG. 4) which is connected, in turn, to a constructional part 11 of the packaging machine or the like.

The essential part of the apparatus is a reel support 12 which is designed as a double-armed construction, with supporting arms 13 and 14 pointing in opposite directions. The reel support 12 can be rotated or pivoted, as a whole, about a middle central bearing 15. Reel holders 16, 17 which each receive a reel 18 and 19 respectively are formed at the ends of the supporting arms 13, 14.

Of the two reels 18 and 19, one or the other is located in the "active" position, namely in the run-off position A, shown in FIG. 1 when the reel support 12 is aligned horizontally. A sheet 20 made, for example, of packaging material, preferably tinfoil, is drawn off continuously from the reel concerned (reel 17 in FIG. 1). The sheet 20 is guided and transported into a conveying region 26 with a vertical plane of movement via a (fixed) deflecting roller 21, via a movable balancing link 22 or via a link roller 23 of the latter, and through an adjoining pair of drawing rollers 24 and 25.

Figure 3:
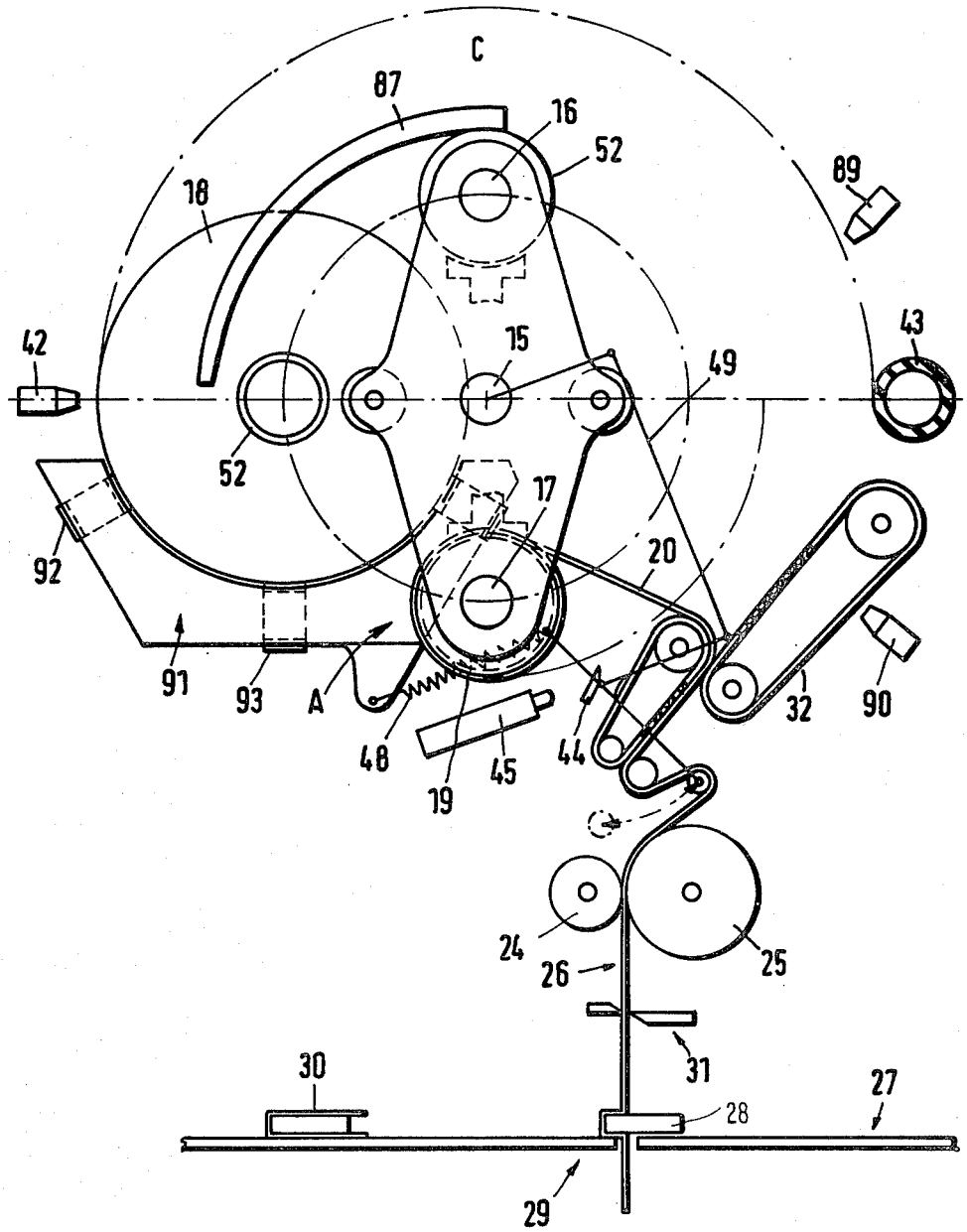
FIG. 3 shows an illustration corresponding to FIGS. 1 and 2, in a position of the reel support changed once again, namely for discarding a reel core.

At a distance below the drawing rollers 24, 25—in the vertical conveying region 26—there is formed a transversely aligned pack track 27 (FIG. 3), on which packs 28 are fed to a folding station 29 not shown in detail. In this, a blank 30 previously severed from the sheet 20 is wrapped round the pack 28 in a U-shape. The blanks 30 are severed from the sheet 20 by a pair of cutters 31 located underneath the drawing rollers 24, 25.

A transfer device 32 precedes or is assigned to the deflecting roller 21. The object of this transfer device is to introduce the start 33 of the sheet 20 of a full reel 18 into the work cycle, with this reel in an appropriate position, that is, to connect said start 33 to the trailing end 34 of the sheet 20 of the reel 19 which has run down or become empty. This is effected due to the fact that the start 33 and end 34 are conveyed in the plane of movement of the sheet 20 without overlapping and without being connected to one another, so that the start 33 and the end 34 are separated a certain minimum distance from one another. Only one, and at most two, faulty packs are obtained as a result—with further difficulties avoided.

In the exemplary embodiment illustrated, the transfer device 32 consists of two suction conveyors arranged in a special relative position to one another, namely a first suction belt 35 and a further transfer suction belt 36. The above mentioned suction belts 35, 36, driven to revolve, are located in an oblique position, in such a way that a (lower) conveying side 37 of belt 35 extends approximately in the same plane as an (upper) feed side 38 of the transfer suction belt 36. Because of the off-set arrangement of the suction belt 35 and transfer suction belt 36, the feed side 38 and conveying side 37 adjoin one another in an inclined plane of movement. Formed in the region where these sides overlap is an air gap 39 which is made narrow and which enables the sheet 20 to be transported by the suction belt 35 even when the transfer suction belt 36 is stopped, that is without friction of the sheet 20 on the latter.

The suction belt 35 is driven constantly, whereas the transfer suction belt 36 is set in motion only intermittently, as is yet to be explained.

The reel support 12 is moved as a result of rotation alternately through 90° or 180° into positions with a horizontal or vertical alignment of the supporting arms 13, 14. The reel holders 16, 17, and the reels 18 and 19 located on these, thereby assume various positions.

In the starting position according to FIG. 1, the "active", virtually emptied reel 19 is in the run-off position A. The supporting arm 13 has been loaded with a full reel 18 which is accordingly in the waiting position B. The sheet 20 is drawn off from the reel 19 by means of the suction belt 35—with the transfer suction belt 36 stationary. The sheet runs over the deflecting roller 21, immediately adjacent to the lower end of the conveying side 37, and the link roller 23 to the drawing rollers 24/25. During this phase, the balancing link 22 has the conventional known function of controlling the tension in the sheet 20.

When the reel 19 is virtually emptied, the reel support 12 is rotated 180° in a clockwise direction. The reel 19 located in the run-off position A is now on the side remote from the transfer device 32. The sheet 20 is guided via one of two guide pulleys 40, 41 located on opposite sides of the reel support 12 (FIG. 2).

The full reel 18 is now located in the waiting position B adjacent to the transfer device 32. The dimensions are selected so that the outer periphery of the full reel 18 rests against the transfer suction belt 36 or against the feed side 38 of the latter, or assumes a minimum distance from this. The free or start end of the sheet 20 on the reel 18 is still fixed to the periphery of the reel by an easily releasable adhesive connection, for example in the form of adhesives applied in spots, an adhesive strip (adhesive film) or else a hot-melt connection which can be dispersed or eliminated as a result of heat transfer.

Figure 2:
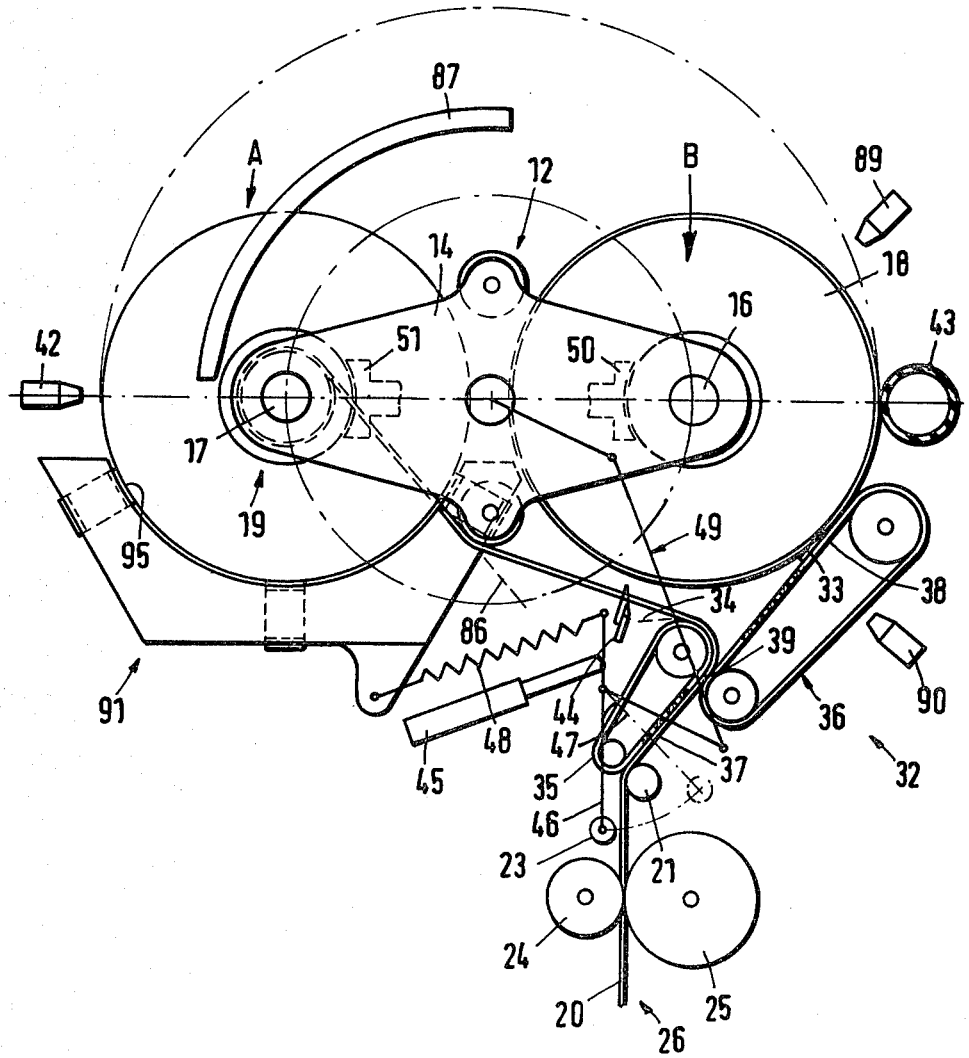
FIG. 2 shows an illustration corresponding to FIG. 1, with a changed position of a reel support and immediately before a sheet change is carried out.

The running-off reel 19 in the run-off position A according to FIG. 2 is monitored by a fixed photocell 42. This triggers the severing and connecting operation by sensing a marking on the sheet 20, when the reel 19 has run off practically completely.

First, the following machine (packaging machine) is shifted down to crawling speed—as a result of a signal from the photocell 42. Furthermore, the full reel 18 located in the waiting position B is made to rotate and is accelerated up to the (reduced) speed of the sheet 20. In the exemplary embodiment illustrated, this purpose is served by a drive pulley 43 which, mounted fixedly, rests against the periphery of the reel 18 and is driven to rotate. Moreover, a photocell 89 is activated, that is to say rendered operative, if appropriate with a time delay. This senses a marking on the reel 18 of the start 33. When the start marking passes the "activated" photocell 89, the transfer suction belt 36 is set in motion and, at the same time, subjected to a vacuum. A relatively precisely calculated time then elapses, until the start 33 of the full reel 18 reaches the transfer suction belt 36 or the feed side 38 subjected to a vacuum. As a result of the suction or holding force, the start 33 is gripped, fixed on the feed side 38 and thereby released from the periphery of the reel 18. The transfer suction belt 36 now conveys the start 33 of the reel 18 or of the sheet 20 into the conveying path of the sheet 20 which is still running.

Synchronised with this, for example as a result of sensing the start 33 by a further photocell 90, a severing cutter 44 for the running sheet 20 is activated and severs the latter. The synchronisation of these operations is such that the end 34 of the sheet 20, which is now running off, and the fed start 33 of the full reel 18 do not overlap one another, but are transported, at a short distance of approximately 5 to 15 mm from one another, in the same plane or track. The transfer suction belt 36 is switched off when the new sheet 20 of the full reel 18 is properly introduced into the transport path.

The suction belt 35 adjoining the transfer suction belt 36 in the conveying direction participates, as a continuation, in the introduction of the start 33 into the proper conveying path and remains constantly in the working position as a permanent guide and directing member for the running-off sheet 20.

To guarantee a proper trouble-free introduction of the start 33 into the plane of movement of the sheet 20, the latter is guided vertically in a region adjoining the deflecting roller 21. For this purpose, the balancing link 22 is pulled back out of its working position during this phase, for example by means of a fixed pressure-medium cylinder 45 controlled by the photocell 42. Its piston rod engages, for pivoting, on a fixedly mounted link arm 46 or on an extension arm 47 of the latter. The balancing link 22 is loaded into the starting position (working position) by a likewise fixedly mounted restoring spring 48 or the like. The pivoting movement out of the position according to FIG. 1 into that according to FIG. 2 is effected against the load of the restoring spring 48.

Adjoining the link arm 46 or the extension arm 47 is an actuating linkage 49, yet to be described in detail, which acts upon reel brakes 50, 51 assigned to each reel 18, 19 or to each reel holder 16, 17. At the beginning of the reel-change phase described here, the reel brakes 50, 51 are released, so that the drive of, particularly, the full reel 18 is made easier. The reel brakes 50, 51 are also controlled by the balancing link 22 during the "normal" working phase, namely the run-off of the sheet 20 from one of the reels, in order to maintain a predetermined tension in the sheet 20.

After the reel change shown in FIG. 2 and described above, the sheet 20 runs off from the reel 18 in the position shown in FIG. 2, until the circumference of this reel 18 is considerably reduced. When a relatively small diameter of the reel 18 is reached, the reel support 12 is rotated 90° in a clockwise direction into an upright position (FIG. 3), in which the reel with the running-off sheet 20 (that is to say, now the reel 19 again) points downwards. The emptied reel 19 or a reel core 52 located directly on the reel holder 16 (or 17) is located in an upper discarding position C on the upper supporting arm 13 or on the reel holder 16. In this position, the empty reel core 52 is ejected from the reel holder 16 in an axial direction, for example onto a chute 53.

Figure 5:
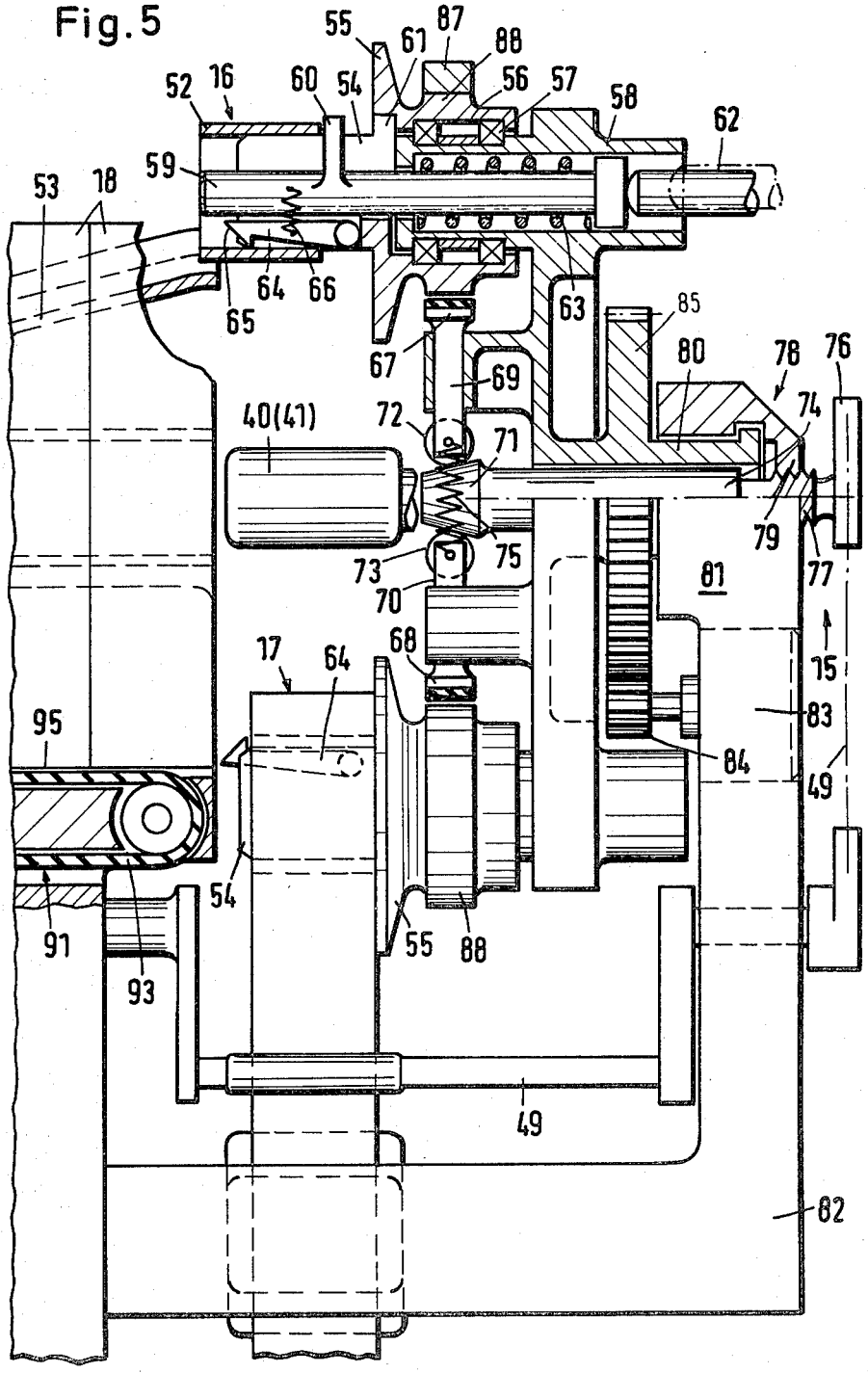
FIG. 5 shows a cut-out of FIG. 4 on an enlarged scale, likewise partly in a vertical section.

The reel core 52 is discarded from the reel holder 16 (or 17) by means of a discarding device which is illustrated in detail in FIG. 5.

Each reel holder 16, 17 is provided with a hub 54 which is mounted on one side and on which the reel core 52 is received. A retaining disc 55, on which the reel or the core 52 are supported in contact, adjoins this hub 54 on one side. A bearing sleeve 56, in one piece with this retaining disc 55, is located on the side lying opposite the hub 54. The bearing sleeve 56 comprises a pivot bearing 57 (roller bearing) which rests on a hollow axle 58 formed at the end of the supporting arms 13, 14. Consequently, the hub 54, retaining disc 55 and bearing sleeve 56 can rotate as a unit on the hollow axle 58.

Mounted to be axially movable in said hollow axle 58 is a discarding ram 59. This extends also in the region of the hollow hub 54. The latter is equipped with several longitudinal slits. Through these pass discarding projections 60 which are connected to the discarding ram 59 and which extend in a radial direction through the slits in the hub 54. In the retracted position, the discarding projections 60 lie in a recess 61 of the retaining disc 55. As a result of axial displacement because of the stressing of the discarding ram 59 by a pressure member 62, the reel core 52 is pushed off from the hub 54 by the correspondingly moved discarding projections 60 distributed uniformly in a peripheral direction, and is consequently discarded. As a result of the action of a compression spring 63, the discarding ram 59 returns into the starting position, when released.

To retain the reels 18, 19 or the reel core 52 on the hub 54 against undesirable displacement, there are provided several hook members 64 which are distributed along the periphery of the hub 54 and which grip by means of a hook stop 65 behind the free outer margin of the reel core 52. The hook members 64 can be pivoted inwards against the radially outward-directed load of a compression spring 66. The mounting and shaping of the hook members 64 are such that the hook members 64 pivot inwards, with the compression spring 66 being compressed, because of the pushing-off movement of the discarding projections 60 or as a result of the increased pressure load by the reel core 52 initiated thereby. The reel core 52 can thus be pushed off from the hub 54.

When a reel holder 16, 17 is loaded with a (full) reel 18, 19, the hook members 64 provided with a sloping run-up face are likewise pivoted inwards, until they snap behind the outer edge of the reel core 52.

The rotation of the reel holders 16, 17 or of the reels 18, 19 located thereon is to be controlled by the reel brakes 50, 51, according to the position and the phase of movement. As is evident especially from FIG. 5, these brakes consist of radially movable brake shoes 67, 68, each assigned to one of the reel holders 16, 17. The brake shoes 67 and 68 are located on a brake push-rod 69, 70 which is moved in a radial direction and up or down. A common adjusting member in the form of a pressure cone 71 is provided for this purpose. The brake push-rods 69, 70 rest by means of supporting rollers 72, 73 against the conical faces of the pressure cone 71. As a result of the geometrical shape of this actuating member for the reel brakes 50, 51, it is ensured that a stressing or control of the reel brakes 50, 51 is possible in any relative position of the reel support 12. When a connecting rod 74 connected to the pressure cone 71 is displaced in an axial direction, the brake shoes 67, 68 are stressed or released. The supporting rollers 72, 73 are drawn against the pressure faces of the pressure cone 71 by a tension spring 75 connecting the ends of the brake push-rods 69, 70 to one another.

The connecting rod 74 is adjustable by means of the balancing link 22 via the actuating linkage 49. A guide bar 76 is pivoted in one direction or the other by the latter. A spindle 77 of a spindle gear 78 is rotated accordingly. The axial movement of the connecting rod 74 connected to the spindle 77 is effected by rotating the spindle 77 in a fixed spindle nut 79.

Figure 4:
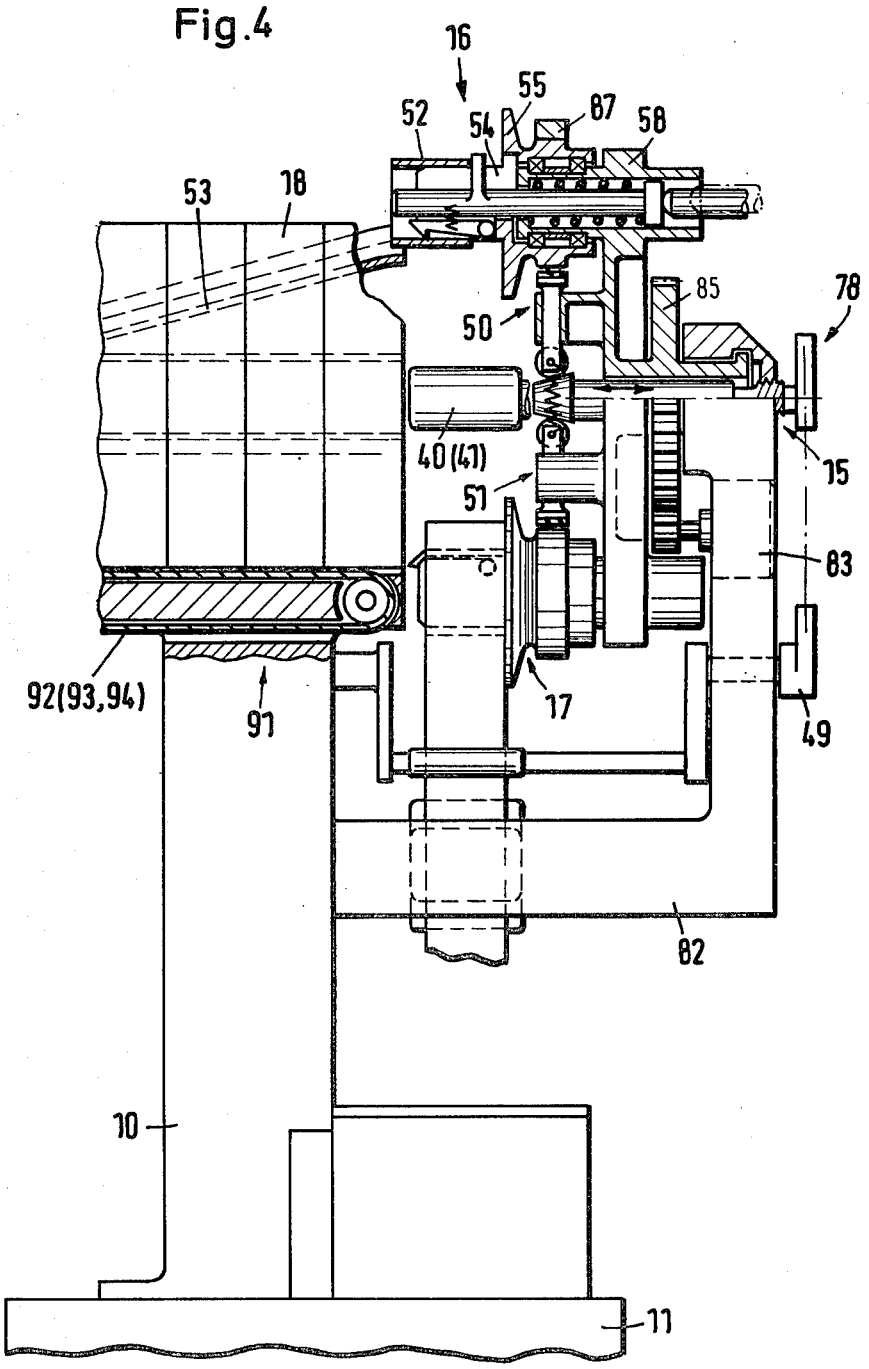
FIG. 4 shows the (supplemented) apparatus according to FIGS. 1 to 3 in a side view, partly in vertical section.

FIG. 4 shows further details of the arrangement and mounting of the reel support 12. This is received, by means of a hollow-axle projection 80, in a central bearing housing 81. This is, in turn, formed at the upper end of an angular supporting arm 82 which itself is connected to the supporting column 10.

The rotary movements of the reel support 12 are effected by means of an electric motor 83 which is mounted to fit into a recess or in the supporting arm 82. The electric motor 83 engages via a pinion 84 with a toothed drive wheel 58 on the hollow-axle projection 80.

The connecting rod 74, already described, for the reel brakes 50, 51, together with a part of the drive for these, is accommodated centrally within the hollow-axle projection 80.

As indicated in FIG. 2, after the sheet 20 has been severed, a residual piece 86 of the latter remains on the emptied reel 19. So that this piece does not cause trouble during the further operations, especially when the reel core 52 is discarded, the reel holder 17 with the emptied core 52 is rotated in a winding-on direction, specifically during the movement of the reel support 12 out of the position according to FIG. 2 into that according to FIG. 3. During this time, the reel holder 17 runs along on a fixed segment 87, on which a brake ring 88 on the outer side of the bearing sleeve 56 makes rotational contact. The brake ring 88 also serves, moreover, to engage the brake shoes 67 and 68 when achieved.

The movements already described, for example the starting of the rotary movement of the full reel 18 in the position according to FIG. 2 and the drive of the transfer suction belt 36, are each controlled by fixed photocells 89, 90.

Figure 6:
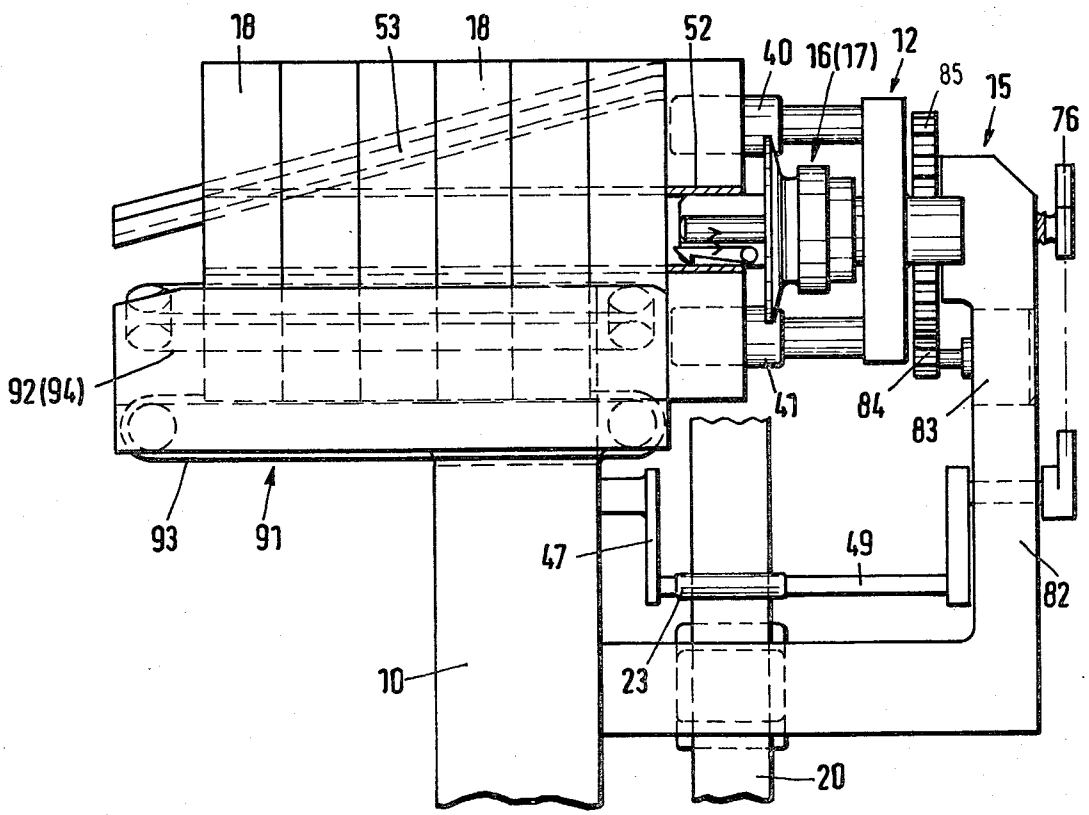
FIG. 6 shows a cut-out of the apparatus in a side view, with a full reel received, partly in cross-section.
Figure 7:
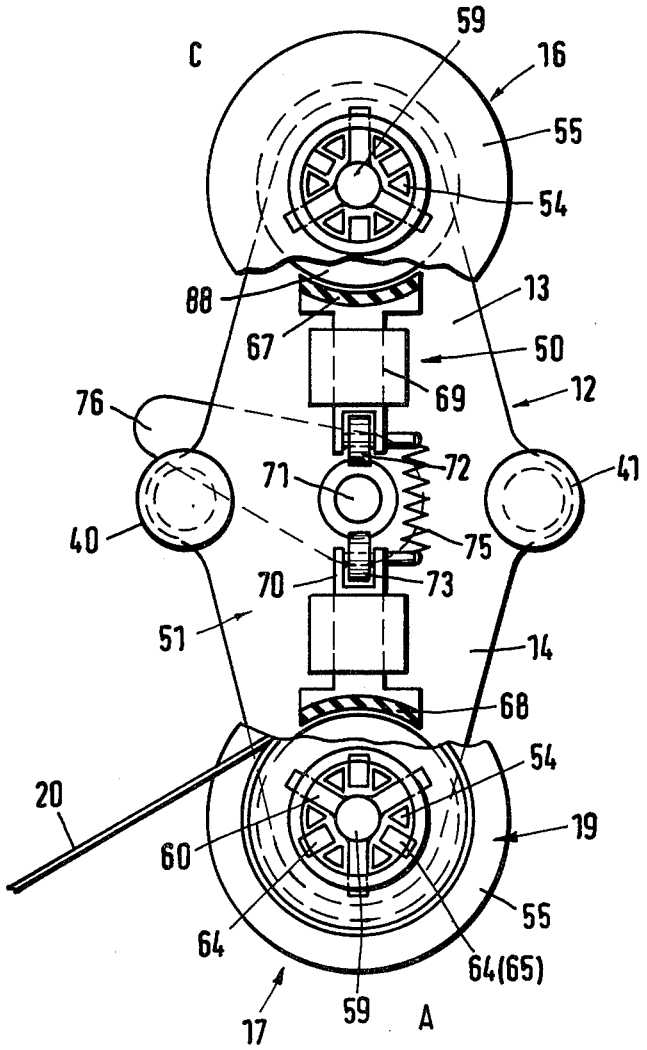
FIG. 7 shows a detail of the apparatus, namely the reel support in an end view on an enlarged scale.

A further special feature of the apparatus emerges, above all, from FIG. 6.

To guarantee a practically uninterrupted operation of the packaging machine, a supply of full reels 18 is constantly kept ready. These are mounted and arranged so that, without an attendant being involved, that is to say automatically, they can be fed to a reel holder 16, 17 kept ready and can be attached to this. A plurality of reels 18 is kept ready for this purpose on a supporting device, adjacent to the (empty) reel holder (for example, 16), in the region of a loading position corresponding to the waiting position B in FIG. 1, that is to say, is formed on the side of the reel support 12 remote from the transfer device 32. The reels 18 lie, in an upright arrangement, with a partial section of their periphery on a supporting framework or trough 91 which holds the reels 18 positively. The relative position is such that the central reel cores 52 extend to the height of the hub 54 of the reel holder 16 which faces the reels 18 with the free end. As a result of displacement of at least the reel 18 adjacent to the reel holder 16, but, in the present case, as a result of movement of the group of reels 18, the reel 18 facing the reel holder is pushed onto the hub 54 and is fixed thereon in the way described.

For this advancing movement of the reels 18, the supporting trough 91 is equipped with conveying members, in the present case with three conveyor belts 92, 93, 94 which are distributed at equal intervals and which run in the longitudinal direction of the supporting trough 91. These project slightly with a conveying side 95 beyond the bearing plane of the supporting trough 91, so that the reels 18 resting on the conveying side 95 can be moved by the conveyor belts 92, 93, 94 in the longitudinal direction of the supporting trough 91.

The conveyor belts 92, 93, 94 are driven by a common drive source (not shown). A connecting gear not illustrated in detail, for example transversely aligned drive shafts located in the region of deflecting wheels and engaged with one another via bevel wheels, effects a complete synchronism of the conveyor belts 92, 93, 94, so that the reels are fed in an exact relative position to the reel holder 16 or 17.

The movement of the conveyor belts 92, 93, 94 is controlled in such a way that, after a reel 18 has been pushed onto the hub 54 kept ready, the remaining reels 18 resting on or in the supporting trough 91 are moved back slightly as a result of a counter-rotating drive of the conveyor belts 92, 93, 94, so that the reel holder 16, 17 or the reel 18 resting thereon moves free of the next following one.

Consequently, when the reel support 12 is situated in the position according to FIG. 1, a full reel 18 is located in the waiting position B. The further operation is now completed in the way described.

All the operations depicted are completed with a sheet 20 which continues to run uninterruptedly and which is drawn off from one or the other reel. In each of the positions provided, the sheet 20 is fed, as a result of appropriate guidance or directing, to the suction belt 35 and introduced by the latter into the prescribed fixed plane of movement.

We claim:

1. A process for supplying webs of packaging material (20) from a plurality of supply reels (18, 19) to a packaging machine, comprising the steps of:

severing a first web (20) being fed to said packaging machine from a first emptying reel (19) by a first conveyor (35) to form a first trailing web end (34) which is to be fed to said packaging machine;

drawing a second leading web end (33) from a second web (20) wrapped on a full second reel (18) off said second reel with a second suction conveyor (36) having one end overlapping an end of said first conveyor and defining therewith a common plane of movement for said first and second webs;

introducing by means of said suction conveyor said second web end (33) from said second reel into said common plane of movement such that said first and second web ends are spaced apart and do not overlap one another; and supplying said second web end to said packaging machine.

2. The process as claimed in claim 1, wherein said second web end is introduced-into said plane of movement of said first web end so as to be spaced apart from said first web end by a distance of between 5 and 15 millimeters.

3. An apparatus for supplying webs of packaging material (20) from a plurality of reels (18, 19) to a packaging machine, comprising:

means (44) for cutting a first web (20) wound on an emptying reel (19) to form a first web end (34);

a transfer device (32) for transferring said first web end into said packaging machine, said transfer device including first and second overlapping revolvable conveyors (35, 36) wherein said first conveyor (36) comprises a suction conveyor;

a reel support (12) for supporting said plurality of reels;

means (83–85) for rotating said reel support to position a full reel (18) fixed thereon to a position adjacent said transfer device while said first web is being transferred from said emptying reel; and means for rotating said full reel while said full reel is adjacent to said transfer device, said transfer device gripping an end (33) of a second web (20) wound on said full reel and transferring said second web end (33) into a plane of movement (37) of said first web end (34) wherein said first and second web ends are spaced apart and do not overlap one another.

4. The apparatus as defined in claim 3, further comprising means (22, 24, 25, 27) disposed between said transfer device and said packaging machine for deflecting said first and second web ends from said plane of movement to a vertical conveying region (26) located downstream of said plane of movement.

5. The apparatus as claimed in claim 4, wherein said second conveyor (35) comprises a second suction conveyor (35) for gripping said second web end and introducing said second web end into said plane of movement, a portion of said second suction conveyor overlapping and adjoining a portion of said first suction conveyor.

6. The apparatus as claimed in claim 5, wherein said second suction conveyor (35) conveys and guides said first and second web ends to said deflecting means (22, 24, 25, 27).

7. The apparatus as claimed in claim 6, wherein said second conveyor (35) grips and introduces said second web end into said plane of movement so that said second web end (33) is spaced apart from said first sheet end (34) by a distance between 5 and 15 mm.

8. The apparatus as claimed in claim 6, further comprising:

first and second reel brakes (50, 51) for braking said emptying reel and said full reel, respectively;

said deflecting means including a balancing link (22) movable between a working position whereat sheet tension is controlled thereby and a non-working position;

said apparatus further comprising means (42, 45–49) for controlling said first and second reel brakes, said control means moving said balancing link from said working position to said non-working position prior to said second web end being introduced into said vertical conveying region (26).

9. The apparatus as claimed in claim 8, wherein said reel support includes first and second arms (13, 14) extending in opposite directions, said emptying and full reels being supported on ends of said first and second arms, respectively, said reel support being rotated by said reel support rotating means to successively move said emptying and full reels to a reel loading position (D), a reel waiting position, reel unwinding positions, and a reel discharging position (C).

10. The apparatus as claimed in claim 9, wherein said discharging position (C) is offset approximately 90° relative to said loading position (D).

11. The apparatus as claimed in claim 10, wherein said transfer device is located in a position which is off-set relative to said vertical conveying region, said transfer device position being substantially below said reel waiting position.

12. The apparatus as claimed in claim 11, further comprising means (59–63) for ejecting an emptied reel core (52) from one of first and second reel holders (16, 17) located on said first and second arms respectively, said reel support rotating means rotating said reel support while said first web is being transferred from said emptying reel to position said emptied reel core on said one of said holders at said reel discharging position so that said emptied reel core can be ejected from said one of said reel holders by said ejecting means.

13. The, apparatus as claimed in claim 12, further comprising means for attaching said full reel to said one of said reel holders after said emptied reel has been ejected therefrom by said ejecting means, said reel support rotating means further rotating said reel support after said emtied reel core has been ejected from said one of said reel holders so that said one of said reel holders is located at said reel loading position (D), said attaching means attaching said full reel onto said one of said reel holders.

14. The apparatus as claimed in claim 13, wherein after said full reel (19) has been attached to said one of said reel holders by said attaching means said reel support rotating means rotates said reel support clockwise 180° to position said full reel at said reel waiting position, said emptying reel being positioned at said reel loading position when said full reel is positioned at said reel waiting position.

15. The apparatus as claimed in claim 14, further comprising means (87, 88) for winding said emptied reel core as said reel support rotating means rotates said emptied reel core to said reel discarding position so that a residual piece (86) of web of said emptied reel core is rewound on said emptied reel core.

16. The apparatus as claimed in claim 15, wherein said emptied reel core winding means comprises a fixed segment (87), said reel support rotating means causing a brake ring (88) of either of said reel brakes to contact said fixed segment when said reel support is rotated to position said emptied reel core at said reel discharging position.

17. The apparatus as claimed in claim 16, further comprising means (91–95) for automatically loading one of a plurality of full reels (18) onto said one of said reel holders after said emptied reel core has been ejected therefrom, said one of said reel holders corresponding to an empty reel holder (16, 17).

18. The apparatus as claimed in claim 17, wherein said automatic loading means includes a supporting framework (91), said automatic loading means transferring said plurality of full reels in a fixed sequence on said supporting framework in an upright position adjacent said empty reel holder so that said plurality of full reels are axially lined with said empty reel holder.

19. The apparatus as claimed in claim 18, wherein said supporting framework comprises a supporting trough (91) having a trough-shaped bearing face, said trough being axially aligned with said empty reel holder.

20. The apparatus as claimed in claim 19, wherein said automatic loading means further comprises a plurality of conveyor belts (92–94) located in said trough-shaped bearing face of said supporting trough, said plurality of conveyor belts being arranged at equal peripheral distances from one another and extending in a longitudinal direction of said supporting trough.

21. The apparatus as claimed in claim 20, wherein said automatic loading means transfers all of said plurality of full reels in a direction of said emptied reel holder so that one of said full reels is transferred onto said empty reel holder, said automatic loading means further comprising means for reversing movement of said plurality of conveyor belts for moving all of said plurality of full reels except for said one of said full reels in a direction away from said emptied reel holder holding said one of said full reels subsequent to said one of said full reels being transferred onto said empty reel holder.

22. The apparatus as claimed in claim 21, further comprising a discharge shute (53) for receiving ejected emptied reel cores, said discharge shute adjoining said one of said reel holders when located at said discharge position.

23. The apparatus as claimed in claim 22, wherein said ejecting means comprises a displacable discharging ram (59) having a plurality of radially extending discharging projections (60) which grip a rear side and an inner side of said emptied reel core and push said emptied reel core off said one of said reel holders.

24. The apparatus as claimed in claim 23, wherein said ejecting means further comprises a restoring spring (63) for displacing said displacable discharging ram back to its original position subsequent to ejecting said emptied reel core, said discharging ram being movable and guided axially within a hollow hub (54) and further being movably guided axially by an adjoining hollow axle (58) and being displacable against a restoring force of said restoring spring.

25. The apparatus as claimed in claim 24, wherein said empty reel holder includes releasable retaining hook members (64) pivotably mounted within said hub for gripping an axial outward side of said emptied reel core by means of a hook stop (65).

26. The apparatus as claimed in claim 25, wherein said control means is responsive to said web tension and controls said reel brakes to control said web tension.

27. The apparatus as claimed in claim 26, wherein said first and second reel brakes each include said brake ring, said reel support including radially movable brake shoes (67, 68) movable in a radial direction for controlling said brake rings.

28. The apparatus as claimed in claim 27, wherein said controlling means comprises:

a second restoring spring (75);

an actuating linkage (49) connected to said balancing link (22); and a centrally mounted axially displacable pressure wedge (71) movable axially by said actuating linkage of said balancing link to stress said brake shoes (67, 68) against a restoring force of said second restoring spring (75).

29. The apparatus as claimed in claim 28, wherein said controlling means further comprises a bearing (15) having a hollow-axle projection (80), and a spindle gear (78) rotated by said actuating linkage for moving said pressure wedge, said pressure wedge being centrally located in said hollow-axle projection.

* * * * *